US009640859B2

(12) United States Patent
Lim

(10) Patent No.: US 9,640,859 B2
(45) Date of Patent: May 2, 2017

(54) ANTENNA APPARATUS AND METHOD OF MANUFACTURING THE SAME

(71) Applicant: LG INNOTEK CO., LTD., Seoul (KR)

(72) Inventor: Dong Uk Lim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 251 days.

(21) Appl. No.: 14/024,905

(22) Filed: Sep. 12, 2013

(65) Prior Publication Data

US 2014/0071019 A1 Mar. 13, 2014

(30) Foreign Application Priority Data

Sep. 13, 2012 (KR) ..... 10-2012-0101788

(51) Int. Cl.

*H01Q 1/36* (2006.01)
*H01Q 1/24* (2006.01)
*H01Q 1/40* (2006.01)

(52) U.S. Cl.

CPC ..... *H01Q 1/36* (2013.01); *H01Q 1/243* (2013.01); *H01Q 1/40* (2013.01); *Y10T 156/1052* (2015.01)

(58) Field of Classification Search

CPC ..... H01Q 1/36
USPC ..... 343/873
See application file for complete search history.

(56) References Cited

U.S. PATENT DOCUMENTS

| | | | | |
|---|---|---|---|---|
| 5,709,832 | A | 1/1998 | Hayes et al. | |
| 2010/0271281 | A1* | 10/2010 | Tsao et al. | 343/873 |
| 2011/0068984 | A1* | 3/2011 | Han | B29C 45/14065 343/702 |
| 2011/0199269 | A1* | 8/2011 | Sung | H01Q 1/243 343/702 |
| 2011/0260932 | A1* | 10/2011 | Hong | B29C 45/14065 343/702 |
| 2012/0235879 | A1* | 9/2012 | Eder | H01Q 1/243 343/873 |

FOREIGN PATENT DOCUMENTS

| | | | |
|---|---|---|---|
| EP | 1 937 039 | A1 | 6/2008 |
| JP | 2002-42079 | A | 2/2002 |
| JP | 3104382 | U | 7/2004 |
| JP | 2005-115862 | A | 4/2005 |
| JP | 2011-66691 | A | 3/2011 |
| JP | 2012-19299 | A | 1/2012 |
| JP | 2012-034167 | A | 2/2012 |

* cited by examiner

*Primary Examiner* — Dameon E Levi
*Assistant Examiner* — Walter Davis
(74) *Attorney, Agent, or Firm* — Birch, Stewart, Kolasch & Birch, LLP

(57) ABSTRACT

Disclosed are an antenna apparatus and a method of manufacturing the same. The antenna apparatus includes a base, a radiation device on the base, and a protective layer formed on the radiation device to expose a partial region of the radiation device. The outer appearance failure of the antenna apparatus can be prevented, and the electrical performance of the antenna apparatus can be ensured.

8 Claims, 3 Drawing Sheets

ANTENNA APPARATUS AND METHOD OF MANUFACTURING THE SAME

BACKGROUND

The embodiment relates to an antenna apparatus and a method of manufacturing the same.

In general, a wireless communication system provides various multimedia services through GPS (global positioning system), Bluetooth, or Internet. In this case, to smoothly provide multimedia service, a high data rate for a huge amount of data must be ensured. To this end, studies and research have been carried out in order to improve the performance of an antenna apparatus. This is because the antenna apparatus substantially makes data communication in a communication terminal. In other words, the antenna apparatus operates at a related resonance frequency band to make data communication.

However, the above antenna apparatus has a problem that components are not coupled with each other with uniform coupling force. In other words, the components in the antenna apparatus may be separated from each other. Therefore, the outer appearance failure of the antenna apparatus may occur, and the electrical performance of the antenna apparatus may be degraded.

SUMMARY

The embodiment provides an antenna apparatus and a method of manufacturing the same, capable of ensuring the electrical performance of the antenna apparatus.

The embodiment provides an antenna apparatus and a method of manufacturing the same, capable of preventing the outer appearance failure of the antenna apparatus. In other words, according to the embodiment, components in the antenna apparatus are coupled with each other with uniform coupling force, thereby preventing the components from being mutually separated from each other.

According to the embodiment, there is provided an antenna apparatus. The antenna apparatus includes a base, a radiation device on the base, and a protective layer formed on the radiation device to expose a partial region of the radiation device.

In this case, the antenna apparatus according to the embodiment further includes a carrier to which the base is attached.

Further, in the antenna apparatus according to the embodiment, the protective layer is formed therein with an exposure groove to form the exposed region at a position corresponding to a position of a curved surface of the carrier.

Meanwhile, according to the embodiment, there is provided a method of manufacturing an antenna apparatus. The method includes forming a radiation device on a base, and forming a protective layer on the radiation device to expose a partial region of the radiation device.

The method according to the embodiment further includes mounting the radiation device on a carrier by attaching the base to the carrier.

In the method according to the embodiment, the forming of the protective layer includes forming the exposed region at a position corresponding to a position of a curved surface of the carrier.

As described above, in the antenna apparatus and the method of manufacturing the same according to the embodiment, as the protective layer is coupled with the radiation device in the antenna device, the radiation device is prevented from being deformed. Further, in the antenna device, the exposure groove of the protective layer exposes the radiation device at a position corresponding to a position of the curved surface of the carrier, so that the radiation device is maintained in the shape corresponding to the shape of the curved surface of the carrier. In other words, the carrier is coupled with the antenna device with uniform coupling force, so that the attachment state between the carrier and the antenna device is maintained. Accordingly, the carrier can be prevented from being separated from the antenna device. Therefore, the outer appearance failure of the antenna apparatus may occur, and the electrical performance of the antenna apparatus may be degraded.

DETAILED DESCRIPTION OF THE EMBODIMENTS

Figure 1:
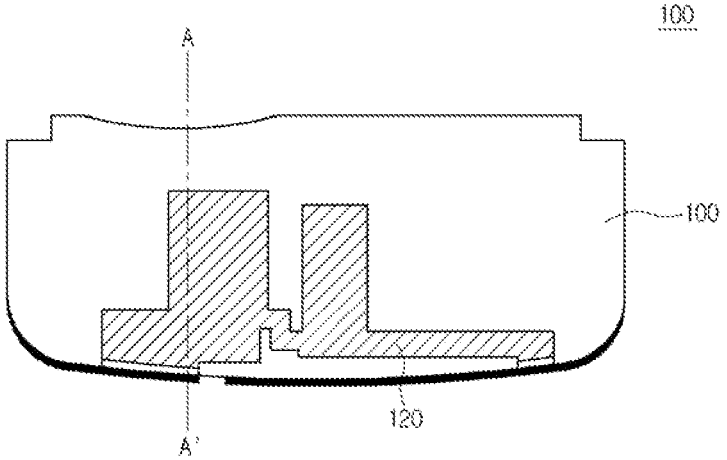
FIG. 1 is a plan view showing an antenna apparatus according to the embodiment.

Hereinafter, the embodiments will be described in more detail with reference to accompanying drawings. In the following description, for the illustrative purpose, the same components will be assigned with the same reference numerals. If it is determined that description about well known functions or configurations may make the subject matter of the embodiments unclear, the details thereof will be omitted.

Figure 2:
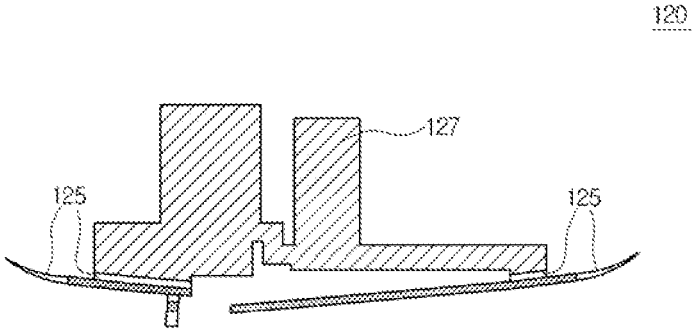
FIG. 2 is a plan view showing an antenna device of FIG. 1.
Figure 3:
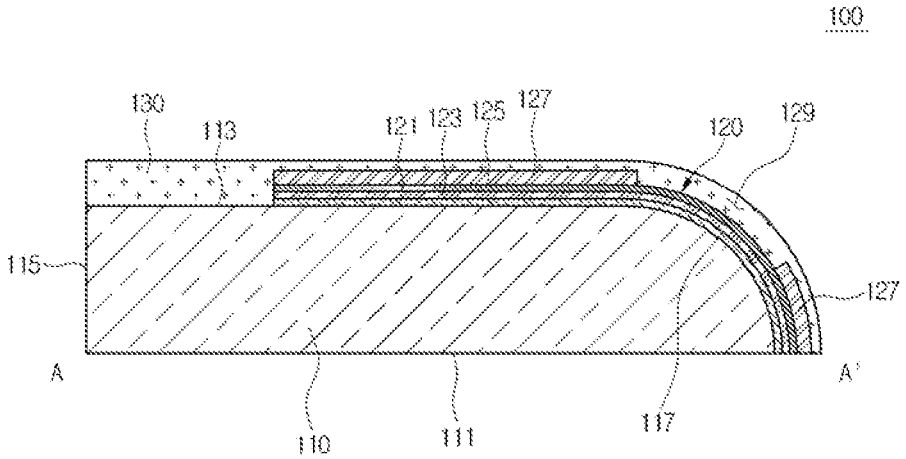
FIG. 3 is a sectional view taken along line A-A□ of FIG. 1.

FIG. 1 is a plan view showing an antenna apparatus according to the embodiment. FIG. 2 is a plan view showing an antenna device of FIG. 1. FIG. 3 is a sectional view taken along line A-A□ of FIG. 1.

Referring to FIGS. 1, 2, and 3, an antenna apparatus 100 according to the embodiment includes a carrier 110, an antenna device 120, and a protective part 130.

The carrier 110 is provided to support the antenna device 120. In other words, the carrier 110 supports the antenna device 120. In this case, the carrier 110 is mounted on an external appliance (not shown). For example, the carrier 110 may be mounted on a driving substrate (not shown) in a communication terminal (not shown). In other words, the carrier 110 supports the antenna device 120 from the external appliance.

The carrier 110 includes a bottom surface 111, a top surface 113, and a lateral side 115. In other words, the carrier 110 is mounted on the external appliance through the bottom surface 111. The top surface 113 is provided in opposition to the bottom surface 111. The lateral side 115 connects the bottom surface 111 to the top surface 113. In this case, the lateral side 115 extends from the bottom surface 111 to the top surface 113, or extends from the top surface 113 to the bottom surface 111. In this case, the lateral side 115 may be bent or curved from the bottom surface 111 while extending. In addition, the lateral side 115 may be bent or curved from the top surface 113 while extending.

In this case, the bottom surface 111 and the top surface 113 may be formed in the same size, or may be formed in sizes different from each other. In addition, the bottom surface 111 and the top surface 113 may have the same shape or shapes different from each other. In addition, when the bottom surface 111 is provided in parallel to the ground surface, the lateral side 115 may be parallel to a vertical axis perpendicular to the ground surface, or may be inclined from the vertical axis.

In addition, the carrier 110 includes at least one curved surface 117. In other words, at least one of the bottom surface 111, the top surface 113, and the lateral side 115 may include the curved surface 117. For example, at least one of the bottom surface 111, the top surface 113, and the lateral side 115 may include a single curved surface 117. In addition, at least one of the bottom surface 111, the top surface 113, and the lateral side 115 includes a plurality of curved surfaces 117, and the curved surfaces 117 may be bent. In addition, a connection part between the bottom surface 111 and the lateral side 115, or the connection part between the top surface 113 and the lateral side 115 may include the curved surface 117.

In addition, the carrier 110 includes a dielectric material. In this case, the carrier 119 may include a dielectric material having a high loss ratio. For example, the conductivity of the carrier 110 may be 0.02. In addition, the permittivity of the carrier 110 may be 4.6.

The antenna device 120 transceives a signal together with the antenna device 100. In this case, the antenna device 120 operates at a preset resonance frequency band according to the intrinsic electrical characteristic. In this case, the electrical characteristic of the antenna device 120 is determined depending on the structure and the shape of the antenna device 120. In addition, the antenna device 120 operates at preset impedance. In addition, the antenna device 120 transceives an electromagnetic wave at a related resonance frequency.

In this case, the resonance frequency band of the antenna device 120 may be classified into a low-frequency band and a high-frequency band. In this case, the resonance frequency band may be a multi-frequency band in which the low frequency band is spaced apart from the high frequency band on a frequency domain. In addition, the resonance frequency band may be a broadband frequency band in which a low-frequency band is combined with a high-frequency band on a frequency domain.

The antenna device 120 is mounted on the carrier 110. In this case, the antenna device 120 is mounted on at least one of the top surface 113 and the lateral side 115 of the carrier 110. In this case, the antenna device 120 may be mounted on the top surface 113, or bent or curved from the top surface 113 so that the antenna device 120 may be mounted on the lateral side 115. In addition, the antenna device 120 may be mounted on the lateral side 115, or may be bent or curved from the lateral side 115, so that the antenna device 120 may be mounted on the top surface 113. In addition, the antenna device 120 closely makes contact with the carrier 110. In this case, the antenna device 120 makes closely contact with the curved surface 117 of the carrier 110. In addition, the antenna device 120 includes a base 121, an adhesive part 123, a radiation device 125, and a protective layer 127.

The base 121 is provided on the carrier 110 in the antenna device 120. In this case, the base 121 is attached to at least one of the top surface 113 and the lateral side 115 of the carrier 110. In addition, the base 121 closely makes contact with the carrier 110. In other words, the base 121 directly makes contact with the carrier 110. In this case, the base 121 closely makes contact with the curved surface 117 of the carrier 110. Accordingly, the base 121 is curved in a shape corresponding to that of the curved surface 117 of the carrier 110. In addition, the base 121 may be formed in the same shape as that of the radiation device 125. In addition, the base 121 includes a thermal bonding material. In this case, the base 121 includes a thermal fusion material. In this case, the base 121 includes thermoplastic resin, For example, the base 121 may include polyester.

The adhesive part 123 is provided on the base 121 in the antenna device 120. In this case, the adhesive part 123 adheres to the base 121. In addition, the adhesive part 123 closely makes contact with the base 121. In other words, the adhesive part 123 directly makes contact with the base 121. Accordingly, the adhesive part 123 is curved in the shape corresponding to the shape of the curved surface 117 of the carrier 110. In this case, the adhesive part 123 may have the shape the same as that of the base 121, or may have the same shape as that of the radiation device 125. In addition, the adhesive part 123 includes an adhesive. The adhesive part 123 includes a thermoactivation material.

The radiation device 125 substantially operates in the antenna device 120 to transceive a signal. In this case, the radiation device 125 determines the electrical characteristic of the antenna device 120. In other words, the electrical characteristic of the antenna device 120 is determined depending on the structure and the shape of the radiation device 125. For example, inductance may be determined depending on the total area of the radiation device 125, that is, the width and the thickness of the radiation device 125. In addition, capacitance may be determined depending on the distance between the radiation device 125 and the ground. In addition, the radiation device 125 operates at the resonance frequency band. In this case, the resonance frequency band is determined depending on the electrical characteristic of the antenna device 120.

The radiation device 125 is provided on the adhesive part 123 in the antenna device 120. In this case, the radiation device 125 adheres to the adhesive part 123. In addition, the radiation device 125 closely makes contact with the adhesive part 123. In other words, the radiation device 125 directly makes contact with the adhesive part 123. Accordingly, the radiation device 125 adheres to the base 121 through the adhesive part 123. In addition, the radiation device 125 is curved in the shape corresponding to the shape of the curved surface 117 of the carrier 110. In addition, the radiation device 125 adheres to the carrier 110 by the base 121. In this case, the radiation device 125 may be formed in the shape the same as that of the base 121, and may be formed in the shape the same as that of the adhesive part 123. Further, the radiation device 125 includes a conductive material. In this case, the radiation device 125 may include at least one of silver (Ag), palladium (Pd), platinum (Pt), copper (Cu), gold (Au), and nickel (Ni).

The protective layer 127 is provided on the radiation device 125 in the antenna device 120. In this case, the protective layer 127 is coupled with the radiation device 125. In addition, the protective layer 127 closely makes contact with the radiation device 125. In other words, the protective layer 127 directly makes contact with the radiation device 125. Accordingly, the protective layer 127 includes a reinforcing material to prevent the radiation device 125 from being deformed. In addition, the protective layer 127 exposes a portion of the radiation device 125. In this case, the protective layer 127 is formed therein with an exposure groove 129. The exposure groove 129 exposes the radiation device 125 at a position corresponding to the curved surface 117 of the carrier 110. Accordingly, the protective layer 127 maintains the protective device 125 to be in the shape corresponding to that of the curved surface 117 of the carrier 110. In addition, the protective layer 127 may include polyimide, polyethylene terephthalate (PET), or silicon (Si).

The protective part 130 protects the antenna device 120 in the antenna apparatus 100. In this case, the protective part 130 protects the antenna device 120 on the carrier 110. The protective part 130 is provided on the antenna device 120. In this case, the protective part 130 is provided on the exposure region of the protective layer 127 and the radiation device 125. Further, the protective part 130 may be additionally provided on at least a portion of the carrier 110 together with the antenna device 120. In this case, the protective part 130 may be provided on at least one of the top surface 113 and the lateral side 115 of the carrier 110. In addition, the protective part 130 may include polyimide, polyethylene terephthalate (PET), or silicon (Si).

Figure 4:
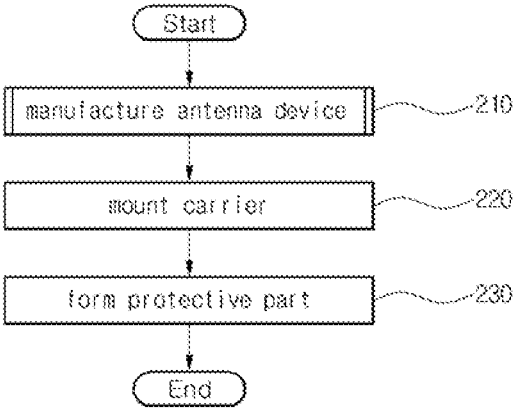
FIG. 4 is a flowchart showing the procedure of manufacturing the antennae apparatus according to the embodiment.

FIG. 4 is a flowchart showing the procedure of manufacturing the antenna device according to the embodiment.

Referring to FIG. 4, the procedure of manufacturing the antenna device 100 according to the embodiment starts from step 210 of manufacturing the antenna device 120. In this case, the antenna device 120 is manufactured in a stacked structure of the base 121, the adhesive part 123, the radiation device 125, and the protective layer 127. Hereinafter, the step of manufacturing the antenna device 120 will be described in more detail.

Figure 5:
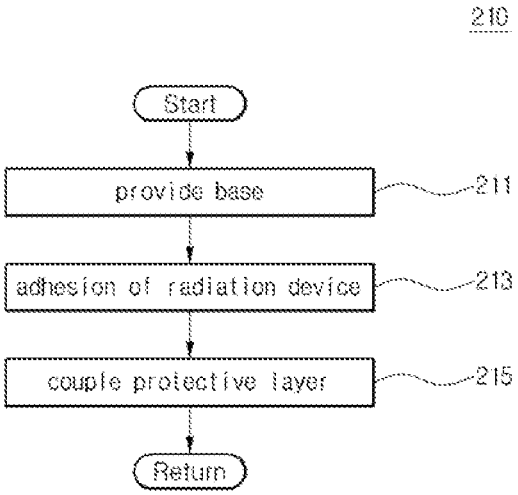
FIG. 5 is a flowchart showing the procedure of manufacturing the antenna device of FIG. 4.

FIG. 5 is a flowchart showing the procedure of manufacturing the antenna device 120 in FIG. 4.

Referring to FIG. 5, the procedure of manufacturing the antenna device 120 starts from step 211 of providing the base 121. In this case, the base 121 is provided in the type of a sheet. The base 121 may include a double-sided tape. The base 121 has one side to which a taper paper is detachably attached. The taper paper may prevent the base 121 from being deformed. Besides, the base 121 includes a thermal fusion material. In this case, the base 121 includes thermoplastic resin. For example, the base 121 may include polyester.

Next, the radiation device 125 adheres to the base 121 in step S213. The radiation device 125 may adhere to an opposite side of the base 121 to which the taper paper is not attached. In this case, the radiation device 125 includes a conductive material. The radiation device 125 may include at least one of silver (Ag), palladium (Pd), platinum (Pt), copper (Cu), gold (Au), and nickel (Ni). The radiation device 125 adheres to the base 121 through the adhesive part 123.

For example, after the adhesive part 123 adheres to the base 121, the radiation device 125 may adhere to the adhesive part 123. In addition after the adhesive part 123 adheres to the radiation device 125, the adhesive part 123 may adhere to the base 121. In addition, the adhesive part 123 includes an adhesive. In this case, the adhesive part 123 includes a thermoactivation material. In addition, the adhesive part 123 may be provided in the type of a sheet, for example, in the type of a double-sided tape. In addition, the adhesive part 123 may be provided in the type of a liquid. In other words, the adhesive part 123 may be coated on at least one of the base 121 and the radiation device 125. In this case, after heating the adhesive part 123, the adhesive part 123 may adhere to the base 121 and the radiation device 125.

Thereafter, the protective layer 127 is coupled with the radiation device 125 on the radiation device 125 in step 215. In this case, the protective layer 127 prevents the radiation device 125 from being deformed. The protective layer 127 may include polyimide, polyethylene terephthalate (PET), or silicon (Si). In addition, the protective layer 127 is formed therein with an exposure groove 129. The exposure groove 129 exposes the radiation device 125 at a position corresponding to the curved surface 117 of the carrier 110. In this case, the protective layer 127 is provided in the type of a sheet, so that the protective layer 127 may adhere to the radiation device 125. In addition, the protective layer 125 may be sprayed from a sprayer, so that the protective layer 125 may be formed on the radiation device 125. Accordingly, the manufacturing procedure of the antenna device 120 is terminated and the process returns to the step of FIG. 4.

For example, after the exposure groove 129 has been formed in the protective layer 127, the protective layer 127 may be coupled with the radiation device 125. In addition, after the protective layer 127 has been coupled with the radiation device 125, the exposure groove 129 may be formed in the protective layer 127. For example, after the exposure member (not shown) has been provided in a portion of the radiation device 125, the protective layer 127 may be formed in a remaining area of the radiation device 125. Thereafter, as the exposure member is removed from the radiation device 125, the exposure groove 129 may be formed in the protective layer 127.

Subsequently, the antenna device 120 is mounted on the carrier 110 in step 220. In this case, the base 121 of the antenna device 120 is mounted on the carrier 110. After heating the base 121, the base 121 may be attached to the carrier 110. For example, after the tape paper has been removed from the base 121, heat may be applied to the base 121. In addition, the antenna device 120 is mounted on at least one of the top surface 113 and the lateral side 115 of the carrier 110. In the antenna device 120, the exposure groove 129 of the protective layer 127 corresponds to the curved surface 117 of the carrier 110.

Finally, the protective part 130 is formed on the antenna device 120 in step 230. In this case, the protective part 130 is formed on the exposure region of the protective layer 127 and the radiation device 125. Further, the protective part 130 may be further formed on at least a portion of the carrier 110 together with the antenna device 120. The protective part 130 may be formed on at least one of the top surface 113 and the lateral side 115 of the carrier 110. In addition, the protective part 130 is provided in the type of a sheet to cover the antenna device 120 on the carrier 110. Further, the protective part 130 is sprayed from a sprayer to cover the antenna device 120 on the carrier 110. In addition, the protective part 130 may include polyimide, polyethylene terephthalate (PET), or silicon (Si). Accordingly, the manufacturing process of the antenna device 100 has been finished.

Meanwhile, according to the present embodiment, an example of forming the antenna device 120 by stacking the base 121, the radiation device 125, and the protective layer 127 is disclosed, but the embodiment is not limited thereto. In other words, after stacking the base 121, the radiation device 125, and the protective layer 127, the stack structure is integrally cut to form the antenna device 120. In other words, the base 121, the radiation device 125, and the protective layer 127 are separately cut and stacked. Alternatively, after stacking the base 121, the radiation device 125, and the protective layer 127, the stack structure may be integrally stacked. Accordingly, the antenna device 120 may be formed in a desirable shape.

According to the present embodiment, as the protective layer 127 is coupled with the radiation device 125 in the antenna device 120, the radiation device 125 can be prevented from being deformed. In the antenna device 120, as the exposure groove 129 of the protective layer 127 exposes the radiation device 125 at a position corresponding to the curved surface 117 of the carrier 110, the radiation device 125 is maintained in the shape corresponding to the shape of the curved surface 117 of the carrier 110. In other words, the coupling force between the carrier 110 and the antenna device 120 is uniformly maintained, so that the mutual attachment state between the carrier 110 and the antenna device 120 is maintained. Accordingly, the carrier 110 is prevented from being separated from the antenna device 120. Accordingly, the outer appearance failure of the antenna apparatus 100 can be prevented, and the electrical performance of the antenna apparatus can be ensured.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An antenna apparatus comprising:
a carrier including a curved surface;
an antenna device mounted on the carrier; and
a protective part formed on the carrier and the antenna device;
wherein the antenna device comprises:
a base on the carrier;
a radiation device on the base; and
a protective layer including a plate surface and a curved surface and formed on the radiation device and including an exposure groove at a partial region of the curved surface of the protective layer for exposing a partial region of the radiation device,
wherein the exposure groove of the protective layer exposes the radiation device at a position corresponding to a position of the curved surface of the carrier, and
wherein the protective part covers the carrier, the protective layer and the radiation device exposed by the exposure groove.

2. The antenna apparatus of claim 1, further comprising an adhesive part interposed between the base and the radiation device such that the base adheres to the radiation device.

3. A method of manufacturing an antenna apparatus, the method comprising:
manufacturing an antenna device;
mounting the antenna device on the carrier; and
forming a protective part on the carrier and the antenna device,
wherein the manufacturing of the antenna device comprises:
forming a radiation device on a base;
attaching the base on a carrier including a curved surface;
forming a protective layer including a plate surface and a curved surface and formed on the radiation device and including an exposure groove at a partial region of the curved surface of the protective layer for exposing a partial region of the radiation device; and
forming a protective part on the protective layer,
wherein the exposure groove of the protective layer exposes the radiation device at a position corresponding to a position of the curved surface of the carrier, and
wherein the protective part covers the carrier, the protective layer and the radiation device exposed by the exposure groove.

4. The method of claim 3, wherein the forming of the radiation device comprises forming the radiation device on the base through an adhesive part allowing the base to adhere to the radiation device.

5. The method of claim 3, further comprising forming a protective part on the exposure groove.

6. The method of claim 3, wherein the attaching of the base to the carrier comprises attaching the base to the carrier by heating the base.

7. The method of claim 3, wherein the forming of the protective layer comprises:
providing an exposure member at the exposure groove in the radiation device;
forming the protective layer on a remaining region of the radiation device; and
removing the exposure member.

8. The method of claim 3, further comprising forming an antenna device having a predetermined shape by integrally cutting the base, the radiation device, and the protective layer.

* * * * *